US005296029A

United States Patent [19]

Neikter

[11] Patent Number: 5,296,029

[45] Date of Patent: Mar. 22, 1994

[54] SPRAYING BOOTH WITH ARRANGEMENT FOR AFFECTING THE MOTIONS OF PAINT PARTICLES

[75] Inventor: Kenneth Neikter, Växjö, Sweden

[73] Assignee: ABB Flakt AB, Sweden

[21] Appl. No.: 910,302

[22] PCT Filed: Jan. 11, 1991

[86] PCT No.: PCT/SE91/00019

§ 371 Date: Jul. 16, 1992

§ 102(e) Date: Jul. 16, 1992

[87] PCT Pub. No.: WO91/11267

PCT Pub. Date: Aug. 8, 1991

[30] Foreign Application Priority Data

Jan. 25, 1990 [SE] Sweden ..... 9000262

[51] Int. Cl.[5] ..... B05B 15/04

[52] U.S. Cl. ..... 118/326; 118/634; 118/64; 118/DIG. 7; 239/104; 239/288

[58] Field of Search ..... 118/64, 309, 314, 315, 118/629, 631, 634, 635, 326, DIG. 7; 454/49, 52, 54, 50; 239/288, 105, 104

[56] References Cited

U.S. PATENT DOCUMENTS 3,741,155 6/1973 Hunder ..... 118/634
3,921,576 11/1975 Vertue ..... 118/634
3,951,293 4/1976 Schulz ..... 215/261
4,664,061 5/1987 Morioka et al. ..... 118/326
4,914,752 4/1990 Hinson et al. ..... 2/2

OTHER PUBLICATIONS

Patent Abstracts of Japan, vol. 11, No. 63, C406, abstract of JP 61-222566, publ Mar. 10, 1986 (Nissan Shatai Co Ltd).

PCT International Publication No.: WO79/00478 (J. D. Toff) Jul. 26, 1979.

*Primary Examiner*—W. Gary Jones
*Assistant Examiner*—Dean T. Nguyen
*Attorney, Agent, or Firm*—Harness, Dickey & Pierce

[57] ABSTRACT

An arrangement for affecting the motions of gasborne, especially air-borne, particles at a movable device, (5,6) comprises an enclosure (12, 22) which encloses said device (5,6) and is connected to a means (16, 28) for supplying or discharging a gas, such as air, to and, respectively, from said enclosure in such an amount that a positive pressure or a negative pressure is maintained therein. Moreover, the enclosure (12, 22) is made of a flexible, gas-permeable material which provides a substantially laminar gas flow downstream of the enclosure and which does not generate particles.

14 Claims, 1 Drawing Sheet

SPRAYING BOOTH WITH ARRANGEMENT FOR AFFECTING THE MOTIONS OF PAINT PARTICLES

FIELD OF THE INVENTION

The present invention relates to an arrangement for affecting the motions of gas-borne, especially air-borne, particles at a movable device, comprising an enclosure which encloses said device and is connected to a means for supplying or discharging a gas, such as air, to and, respectively, from said enclosure in such an amount that a positive pressure or a negative pressure is maintained therein.

In the first place, the invention relates to an arrangement for preventing paint particles from being deposited on a painting machine for spray painting e.g. a car body. In the second place, the invention relates to an arrangement for preventing the emission of dust particles from a manufacturing machine in what is generally referred to as a clean room for manufacturing e.g. electronic components.

The invention is, however, applicable also in many other fields.

DESCRIPTION OF THE PRIOR ART

Unfortunately, in spray painting of car bodies in a spray booth, paint particles adhere not only to the car bodies. A large amount of these particles accompany the ventilation air out of the booth, whereas a minor part of the particles adhere to painting machines or operators. The paint particles adhering to, for example, the painting machines will build up accumulations of paint particles thereon. In course of time these accumulations will grow and become so large and heavy that parts thereof come loose and are entrained by the ventilation air towards the floor of the spray booth and the car bodies advanced across the floor. There is a great risk that part of the dried paint particles falling down land on a car body and adhere to its not yet dry surface layer.

Owing to the high demands which consumers place on the quality of the surface layer of a car body, a few dry particles adhering to the surface layer are enough to necessitate extensive touch-up work, i.e. grinding and repainting of damaged parts of the surface layer, before the car body can be approved. Such touch-up work is both time-consuming and demands great resources, since in most cases manual work is involved.

In order to prevent the surface layer from being damaged, the painting machines must consequently be cleaned at such short intervals that no large and heavy accumulations of paint particles have time to form thereon. However, it is an inconvenient and time-consuming operation to clean the machines. To simplify the cleaning, the parts of the machines which are most subjected to paint deposit have recently become coated with a thin, gas-impermeable plastic film. As a result, a great part of the paint deposit occurs on the plastic films which must be replaced at certain intervals, for example 2-hour intervals, in order to prevent the formation of so large accumulations of paint particles on the plastic films that there is a risk that parts of the accumulations come loose from the plastic films and adhere to the surface layer of the car body. However, providing all painting machines with new plastic films several times during a working period is an operation which demands a great deal of work and is time-consuming as well as expensive. Besides, the parts of the machines which are less subjected to paint deposit and therefore are not coated still need to be cleaned. The reason why not the entire painting machines are coated with plastic film is that it will take longer to coat the entire machines than to clean the last-mentioned parts.

In the manufacture of electronic components, extremely high demands are frequently placed on the purity of the surrounding air. Certain components can be damaged even by very small particles. The manufacture therefore takes place in closed spaces which are known as clean rooms and to which finely filtered air is supplied. Unfortunately, some particles are also produced inside the clean room by the manufacturing machines and/or the people who are engaged in manufacturing the components. Consequently it is important that the particles present in the clean room are prevented as far as possible from contacting the components which are being manufactured therein.

SUMMARY OF THE INVENTION

Technical Problem

It thus constitutes a technical problem to prevent paint particles from being deposited on painting machines, such as painting automatics or robots.

It also constitutes a technical problem to prevent the emission of particles from manufacturing machines, such as manufacturing robots or automatics, when manufacturing electronic components or other dust-sensitive products in clean rooms, and to collect, in such spaces, particles generated in some other manner.

The object of the present invention therefore is to provide a simple and inexpensive arrangement for affecting the motions of gas-borne particles at a movable device, especially for preventing paint particles from being deposited on a painting machine, such as a painting automatic or robot, in a spray booth, and for preventing the emission of dust particles from a manufacturing machine, such as a manufacturing robot or automatic, in a clean room.

Solution of the Problem

According to the present invention, the above-mentioned problems with paint deposits at a movable device, such as a painting machine, when painting e.g. car bodies, and with collection of particles in a clean room are solved by means of an arrangement which is of the type mentioned by way of introduction and is characterised in that the enclosure is made of a flexible, gas-permeable material which provides a substantially laminar gas flow downstream of said enclosure and which does not generate particles.

When a positive pressure is maintained in the gas-permeable enclosure, gas thus flows out through the enclosure, and particles, such as paint particles, which are moving towards the device are repelled. On the other hand, when a negative pressure prevails in the enclosure, gas from the surroundings flows in through the gas-permeable enclosure, and particles, such as dust particles, adjacent the device are entrained and kept on the enclosure as long as the negative pressure is maintained.

Since the enclosure is made of a material which does not generate particles, there is no risk that, when gas flows through the enclosure, particles are formed which could adhere to, for example, the surface layer of a newly painted car body.

The gas-permeable material preferably is an elastic polymer which is woven of extruded, single filaments (monofilaments). An example of a suitable material is polytetrafluoroethylene (PTFE). However, it is not possible to make the enclosure of, for example, a perforated metal sheet, since the perforations cannot be made so close together that when gas passes through the enclosure the reduction of the through-flow area and, thus, the increase in velocity and the risk of whirling downstream of the enclosure will be negligible.

The means for generating a positive pressure and a negative pressure in the enclosure can be a fan.

DESCRIPTION OF A PREFERRED EMBODIMENT

Figure 1:
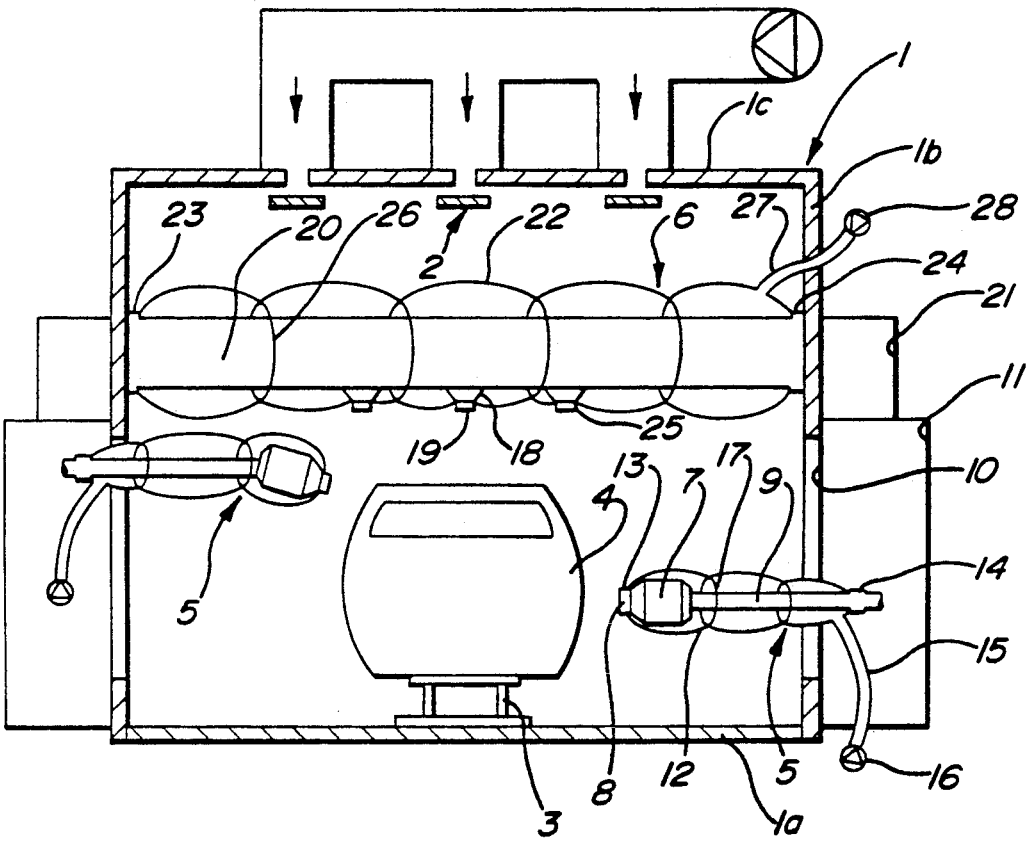
FIG. 1 is a schematic drawing of the arrangement for affecting the motions of paint particles in a spraying booth.

The invention will now be described in more detail with reference to the accompanying drawing which is a vertical section of a spray booth comprising painting automatics and arrangements according to the present invention for affecting the motions of paint particles at the painting automatics.

The drawing illustrates a spray booth 1 having a floor grating 1*a*, two substantially tight walls 1*b* and a roof 1*c*. Three air supply means 2 for supplying ventilation air to the spray booth 1 are mounted in the roof 1*c* of the spray booth. A mechanical conveyor 3 conveys car bodies 4 through the spray booth 1 just above the floor grating 1*a* thereof. The spray booth accommodates 6 painting automatics 5, of which only two are shown in the drawing, for spray painting the lateral surfaces of the car body, and a painting automatic 6 for spray painting the remaining surfaces, i.e. the front part, the top and the rear part of the car body.

Each of the side painting automatics 5 comprises a spray head 7 having a spray nozzle 8, said spray head being turnably mounted on one end of a substantially horizontal bar 9. The other end of the bar is, outside the spray booth wall 1*b*, connected to a prior art means (not shown) for raising and lowering the bar. The bar 9 extends through a vertical slit 10 in the wall. Said means is, for reasons of security, mounted in a separate cabinet 11 positioned adjacent the spray booth.

The side painting automatic 5 is enclosed by an enclosure 12 made of a flexible, gas-permeable material, such as polytetrafluoroethylene (PTFE), and extending along the spray head 7 and the bar 9. At both ends, the enclosure is open but secured by means of two clamps 13, 14 so as to come into close contact with the spray nozzle 8 of the spray head 7 and the other end of the bar 9, respectively. Via a tube 15, the enclosure 12 is connected to a fan 16 for supplying air in such an amount that a positive pressure is maintained in the enclosure.

The positive pressure in the enclosure implies, inter alia, that the enclosure is expanded around the painting automatic 5. To limit the expansion, the enclosure is provided with two stiffening means 17 in the form of circular bands which can be made of steel or plastic, along the portion of the enclosure which is adapted to be positioned along the bar 9.

The painting automatic 6 for painting the front part, the top and the rear part of the car body comprises three spray heads 18, each having a spray nozzle 19 and mounted on a beam 20. The beam 20 extends across the entire spray booth 1 and is, at both ends, connected to prior art means (not shown) for raising and lowering the beam. These means are, like the above-mentioned means for raising and lowering the side painting automatic, mounted in cabinets 21 positioned outside the spray booth walls 1*b*. Like the bar 9, the beam therefore extends through a vertical slit in the walls 1*b*. The beam 20 is turnably connected to the above-mentioned means so that after the beam has been turned through about 90°, the spray heads 18 can also spray paint on the vertical portions of the front and rear parts.

The top painting automatic 6 is, in the same manner as described above for the side painting automatic 5, enclosed by a flexible, gas-permeable enclosure 22. The enclosure extends along the entire beam 20 and is secured to the ends thereof and to the spray nozzles 19 by means of clamps 23, 24 and 25, respectively. The enclosure is also provided with four stiffening means 26 in the form of circular bands which are positioned at intervals of about 1 m along the beam 20 and are made of steel or plastic. Via a tube 27, the enclosure is connected to a fan 28 for generating a positive pressure in the enclosure.

In order to reduce the risk that particles enter the spray booth through the vertical slits 9 in the booth walls 1*b* and the corresponding slits (not shown) for the top painting automatic 6, the slits are provided with rubber seals (not shown). To further reduce this risk, the air pressure of the cabinets 11 and 21 is kept lower than the air pressure of the spray booth 1.

The function of the enclosures will be described in detail below with reference to the accompanying drawing. The car body 4 is advanced through the spray booth 1, resting on the conveyor 3, at a velocity of about 0.025 m/s. At the same time, ventilation air is supplied through the air supply means 2 in the roof 1*c*, flows down through the spray booth 1 and is exhausted through the floor grating 1*a*. The ventilation air supplied is filtered and the temperature and moisture thereof are controlled. The exhausted, polluted ventilation air is cleaned in a Venturi-type separator (not shown) mounted under the spray booth floor 1*a*, before being emitted into the atmosphere or recirculated to the spray booth.

The car body 4 first reaches the side painting automatics 5 spraying paint on the lateral surfaces of the car body, and subsequently the top painting automatic 6 spraying paint on the remaining surfaces. Unfortunately, not all the paint particles flow towards the car body and are caught on the surface thereof, but some particles instead move towards the enclosures 12, 22 of the painting automatics.

A positive pressure of about 1,000 Pa prevails inside the enclosures 12, 21, and since they are air-permeable, part of the air flows out through the enclosures at a velocity of about 0.5 m/s. This flow of air has a repelling effect on the paint particles moving towards the enclosures. This implies that these particles are prevented from reaching the outside of the enclosures and consequently they do not adhere to the enclosures. The paint particles are instead entrained by the ventilation air flowing through the spray booth, to the above-mentioned Venturi-type separator. The particles which, while being entrained, hit the car body have, however, not had time to dry so much as to significantly affect the appearance of the surface layer of the car body.

The air flowing out through the gas-permeable enclosures 12, 22 can also promote a certain focusing of the paint which is sprayed in the form of a mist, thereby increasing the degree of utilisation of the paint, i.e. a larger amount of the paint reaches the car body 4.

The invention is of course not limited to the embodiment described above, but can be modified in various ways within the scope of the appended claims.

For example, the means for generating a positive pressure in the enclosures 12, 22 can be a simple compressor instead of a fan.

For example, the spray booth can be exchanged for a clean room, and the painting automatics can be exchanged for manufacturing robots. In this application, it can also be appropriate to ventilate the clean room with an inert gas, such as argon, instead of air, and in this case, an inert gas thus is exhausted from the enclosures enclosing the manufacturing robots.

I claim:

1. A spraying booth comprising an arrangement for preventing paint particles from being deposited on a painting device comprising an enclosure which encloses said device and is connected to a means for supplying or discharging a gas to and, respectively, from said enclosure in an amount that a positive pressure or negative pressure is maintained therein, wherein said enclosure is made of a flexible, gas-permeable material which provides a substantially laminar gas flow downstream of said enclosure and which does not generate particles.

2. The arrangement as claimed in claim 1, wherein said material is an elastic polymer.

3. The arrangement as claimed in claim 2, wherein said means for supplying or discharging comprises a fan.

4. The arrangement as claimed in claim 3 wherein said painting device is a painting machine.

5. The arrangement as claimed in claim 4 wherein said painting machine is further comprised of a painting automatic.

6. The arrangement as claimed in claim 2 wherein said painting device is a painting machine.

7. The arrangement as claimed in claim 6 wherein said painting machine is further comprised of a painting automatic.

8. The arrangement as claimed in claim 2, wherein said elastic polymer comprises polytetrafluoroethylene.

9. The arrangement as claimed in claim 8, wherein said means for supplying or discharging comprises a fan.

10. The arrangement as claimed in claim 1, wherein said means for supplying or discharging comprises a fan (16, 28).

11. The arrangement as claimed in claim 10 wherein said painting device is a painting machine.

12. The arrangement as claimed in claim 11 wherein said painting machine is further comprised of a painting automatic.

13. The arrangement as claimed in claim 1 wherein said painting device is a painting machine.

14. The arrangement as claimed in claim 13 wherein said painting machine is further comprised of a painting automatic.

* * * * *